United States Patent [19]

Lin

[11] Patent Number: 4,846,667

[45] Date of Patent: Jul. 11, 1989

[54] LIGHTER WITH A WINDPROOF AND RAINPROOF ASSEMBLY

[76] Inventor: Benge Lin, 2F., No. 149, Moo Tsar Road, Sec. 3, Taipei, Taiwan

[21] Appl. No.: 244,278

[22] Filed: Sep. 15, 1988

[51] Int. Cl.[4] ..... F23Q 25/00

[52] U.S. Cl. ..... 431/151; 431/152; 431/146

[58] Field of Search ..... 431/253, 151, 152, 148, 431/146, 350

[56] References Cited

U.S. PATENT DOCUMENTS 4,371,331 2/1983 Lee ..... 431/151
4,531,906 7/1985 Mizukami ..... 431/146

FOREIGN PATENT DOCUMENTS 652738 3/1929 France ..... 431/151
2170891 8/1986 United Kingdom ..... 431/151

*Primary Examiner*—Randall L. Green
*Attorney, Agent, or Firm*—Notaro & Michalos

[57] ABSTRACT

A lighter with a windproof and rainproof assembly includes a shell and a similarly shaped cup for containing a lighter. A connecting piece is connected to the cap and extends into a space between the lighter and shell. A control piece mounted on the end of the connecting piece is placed in a gap formed on the back surface of the shell for limiting the movement of the connecting piece and cap. Elastic projections in the gap act as stops for the control piece.

4 Claims, 3 Drawing Sheets

LIGHTER WITH A WINDPROOF AND RAINPROOF ASSEMBLY

FIELD AND BACKGROUND OF THE INVENTION

The present invention relates to a lighter and more particularly to a windproof and rainproof lighter.

In conventional lighters, a safety mechanism has not been provided for preventing the fire from being extinguished. While a lighter is being used outside, the fire of the lighter is often extinguished by unexpected wind or rain. Obviously, this is a problem when using a lighter.

In order to overcome this affliction, the present inventor has invented the present invention to provide a perfect product for preventing the fire of a lighter from being extinguished.

SUMMARY OF THE INVENTION

The primary object of the present invention is to provide a lighter with a windproof and rainproof assembly including a safety assembly for preventing the ignited fire from being extinguished by unexpected wind or rain.

A further object of the present invention is to provide a lighter with a windproof and rainproof assembly comprising a shell and slidable cap for containing a lighter.

Another object of the present invention is to provide a lighter with a windproof and rainproof assembly which is easy and inexpensive to manufacture.

Other objects, features and advantages of the present invention will be apparent from the following detailed description there of when taken in conjunction with the accompanying drawings.

DESCRIPTION OF THE PREFERRED EMBODIMENTS

Figure 1:
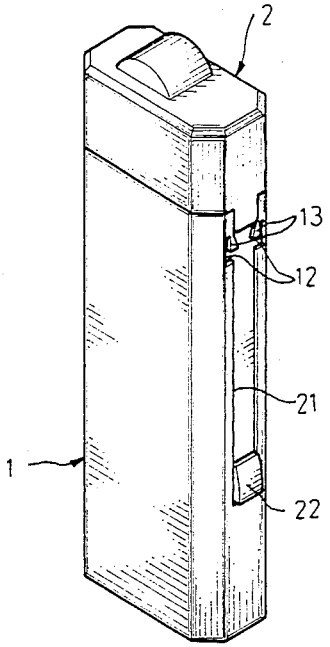
FIG. 1 is a perspective view of a lighter with a safety assembly in accordance with the present invention.
Figure 2:
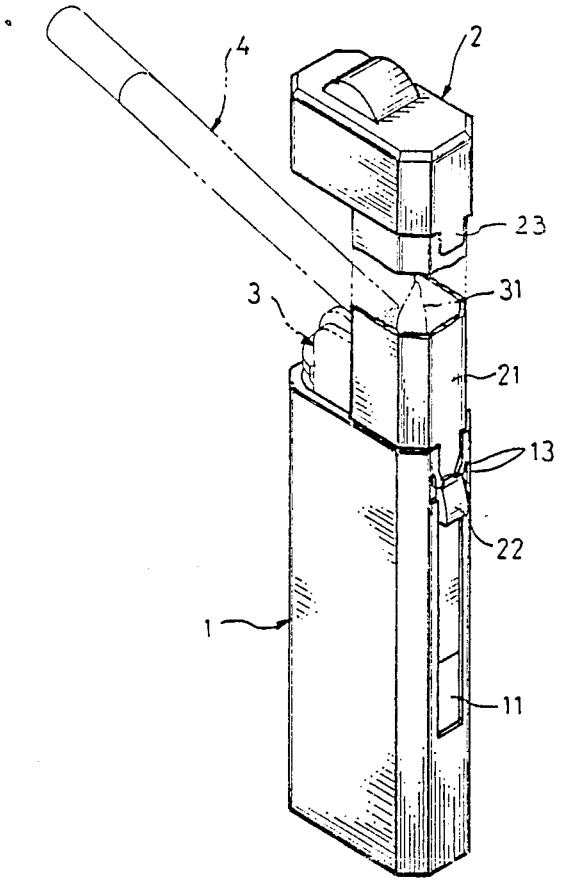
FIG. 2 is a perspective view according to a first embodiment of the present invention with its cap open.

Referring to figures of the drawings and particularly to FIGS. 1 and 2, the present invention includes a shell 1 for containing a lighter 3. The shell 1 is provided with a longitudinal gap 11 on its back surface, which is formed with two symmetrical L-shaped slits 12 near the upper open end of the gap 11. Slits 12 leave two elastic projections 13 of shell 1 that extend into the longitudinal gap 11. A cap 2 is provided for engaging the shell 1 and covering the lighter 3. The cap 2 has a connecting piece 21 which has a U-shaped cross-sectional structure for sliding insertion into a space between the lighter 3 and the shell 1. The back surface of the connecting piece 21 is provided with a control piece 22. When the cap 2 is engaged with the shell 1, the control piece 22 is inserted along the longitudinal gap 11. When the control piece 22 reaches the elastic projections 13, it will push the two projections outwardly, and after passing them, the two projections 13 will go back to their original position as shown in FIG. 1. This limits the motion of control piece 22 which can only move in the gap 11, under the elastic projections 13.

Cap 2 has a back, a front, two side and a top wall for covering the top end of lighter 3 while connecting piece 21 has a back and two side wall for engaging the back and sides of lighter 3. Shell 1 has a back, a front and two side walls for covering the bottom end of lighter 3.

Users of the invention can push the control piece 22 upwardly to lift the cap 2, then ignite the fire 31 of the lighter 3 for lighting up and so on. Since the cap 2 of the present invention is made of fireproof material, the semi-closed space of the cap 2 and connecting piece 21 obviously function to prevent the ignited fire 31 of the lighter 3 from being extinguished by any unexpected wind or rain.

Projections 13 each have inwardly and downwardly inclined top edges so that control piece 22 can push past the projections as they are pressed into slits 12.

The back side of connecting piece 21 also carries a tab 23 which is inserted into the upper open end of gap 11 when cap 2 is lowered, to engage in gap 11 just over projections 13.

Figure 3:
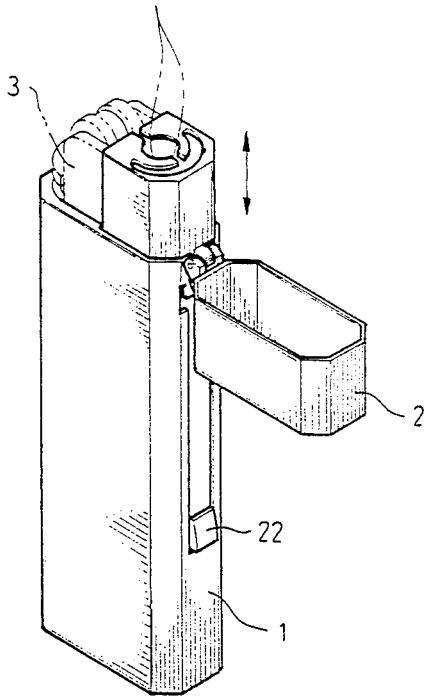
FIG. 3 is a perspective view according to another embodiment of the present invention with its cap open.

FIG. 3 shows another embodiment according to the present invention. In this embodiment, the cap 2 and connecting piece 21 are connected to each other by a pivotal hinge. The cap 2 has the same cross-sectional strucure as the shell and has its rear end pivoted to the upper end of the connecting piece 21. In this way, the lighter can be used in rooms or windless places, as is known, by opening the cap 2 directly, as shown in FIG. 3, and then igniting the lighter for a simplified operation.

Although the present invention has been described with a certain degree of particularity, it is understood that the present disclosure is made by way of example only and that numerous changes in the detail and the combination and arrangement of parts may be resorted to without departing from the scope and spirit of the invention as herein after claimed.

I claim:

1. A lighter with a windproof and rainproof assembly, comprising:

a shell having a back wall, a front wall and two side walls for receiving a lower end of the lighter, the back wall of said shell including a longitudinal gap having an open upper end, and two symmetrically positioned L-shaped slits in said shell on opposite sides of said gap near said upper open end of said gap, each slit defining an elastic projection extending into said gap, each elastic projection having an inwardly and downwardly inclined top edge extending into said gap; and a cap having a back wall, a front wall, two side walls and a top wall for covering an upper end of the lighter;

a connecting piece connected to said cap and slidably insertable into a space between the lower end of the lighter and said shell, said connecting piece including a back wall and two side walls for engaging a back and sides of the lighter; and a control piece connected to said back wall of said connecting piece and slidably engaged in said gap below said elastic projections;

whereby said connecting piece is slidably engaged into said shell by pressing said control piece past said elastic projections into said gap, said cap and connecting piece being slidable away from said shell to expose the upper end of the lighter for a lighting operation, while said walls of said cap and connecting piece protect the upper end of the lighter from wind and rain.

2. A lighter with waterproof and rainproof assembly according to claim 1 including a tab extending over an upper part of said back wall of said connecting piece and engageable into said gap above said elastic projections when said cap covers the upper end of the lighter.

3. A lighter with waterproof and rainproof assembly according to claim 2 including a hinge pivotally connecting said back wall of said cap to said back wall of said connecting piece.

4. A lighter with waterproof and rainproof assembly according to claim 1 including a hinge pivotally connecting said back wall of said cap to said back wall of said connecting piece.

* * * * *